US008218826B2

(12) United States Patent
Ciglenec et al.

(10) Patent No.: US 8,218,826 B2
(45) Date of Patent: Jul. 10, 2012

(54) INTEGRATED MEASUREMENT BASED ON AN OPTICAL PATTERN-RECOGNITION

(75) Inventors: Reinhart Ciglenec, Katy, TX (US); Peter Swinburne, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 1335 days.

(21) Appl. No.: 11/740,745

(22) Filed: Apr. 26, 2007

(65) Prior Publication Data

US 2008/0035324 A1 Feb. 14, 2008

Related U.S. Application Data

(60) Provisional application No. 60/747,724, filed on May 19, 2006.

(51) Int. Cl.
*G06K 9/00* (2006.01)
*E21B 29/02* (2006.01)

(52) U.S. Cl. ..... 382/109; 166/64

(58) Field of Classification Search ..... 382/109; 166/66, 77.2, 350, 351, 352, 353, 354, 355, 166/64, 245, 255.1, 255.2, 265, 266, 360, 166/366, 368; 254/266, 275, 286, 900; 345/39, 345/46; 347/130; 348/801; 362/249.02, 362/311.02, 345, 555, 612, 800
See application file for complete search history.

(56) References Cited

U.S. PATENT DOCUMENTS

| | | | | |
|---|---|---|---|---|
| 2,782,515 | A | 11/1955 | Mayes | |
| 3,490,149 | A | 1/1970 | Bowers | |
| 3,497,958 | A | 3/1970 | Gollwitzer | |
| 4,179,817 | A | 12/1979 | Lavigne | |
| 4,282,523 | A | 8/1981 | Youmans | |
| 4,545,017 | A | 10/1985 | Richardson | |
| 4,718,168 | A | 1/1988 | Kerr | |
| 4,791,618 | A | 12/1988 | Purchnik | |
| 4,852,263 | A * | 8/1989 | Kerr | 33/735 |
| 5,062,048 | A | 10/1991 | Coulter | |
| 5,469,916 | A * | 11/1995 | Sas-Jaworsky et al. | 166/64 |
| 6,216,789 | B1 * | 4/2001 | Lorsignol et al. | 166/355 |
| 6,843,318 | B2 * | 1/2005 | Yarbro | 166/255.2 |
| 2003/0118230 | A1 * | 6/2003 | Song et al. | 382/152 |
| 2007/0035736 | A1 * | 2/2007 | Vannuffelen et al. | 356/432 |

FOREIGN PATENT DOCUMENTS

| | | |
|---|---|---|
| WO | 8805112 | 7/1988 |

* cited by examiner

*Primary Examiner* — Abolfazl Tabatabai
(74) *Attorney, Agent, or Firm* — David J. Smith; Michael L. Flynn; Jody DeStefanis

(57) ABSTRACT

A measurement system is provided that includes an integrated optics unit which measures at least one variable of the movement of a conveyance system relative to an oil well during an oil well operation, wherein the at least one variable is a direction of motion, a speed of movement, or a length of movement of the conveyance system.

20 Claims, 2 Drawing Sheets

INTEGRATED MEASUREMENT BASED ON AN OPTICAL PATTERN-RECOGNITION

CROSS-REFERENCE TO RELATED APPLICATION

This application claims priority under 35 U.S.C. §119(e) to U.S. Provisional Application Ser. No. 60/747,724, filed on May 19, 2006, which is incorporated herein by reference.

FIELD OF THE INVENTION

The present invention relates generally to a system and method for measuring at least one variable of the movement of a conveyance system relative to an oil well during an oil well operation, and specifically to such a system and method that includes an integrated optics unit. In one embodiment, the integrated optics unit measures at least one variable of the movement of a conveyance system relative to an oil well during an oil well operation without physically contacting the conveyance system. In a specific example, the system and method is used to measure a cable length and associated well depth of the cable during an oil well logging operation.

BACKGROUND

Accurate depth measurement is an important parameter when performing a logging operation in an oil well. Inaccuracies in these measurements can cause tremendous problems in reservoir evaluation, in reservoir management, and in calculating reserves, among other problems. For wireline logging operations, a cable spooling and measuring device may be used to measure the spooled cable length. This device includes a pair of measurement wheels, through which a cable is spooled. These wheels are pressed from opposite directions to the cable and rotate in unison as the cable moves therebetween. With this arrangement, the length of the cable passing through the wheels can be measured by measuring the rotation of the wheels and knowing the circumference of the wheels.

However, this system has inherent shortcomings. For example, the quality of the measurement relies largely on the assumption that there is no slippage between the cable motion and the wheel rotation. Yet, this assumption is not always valid, especially in situations where the cable speed is high or when the cable abruptly changes directions of motion.

In addition, the wheels themselves are subject to wear and tear, which over time causes a groove in the wheels, which changes the diameter of the wheels and causes for an inaccurate measurement of the cable depth in the well. Also, the wheels are subject to damage by corrosive mud and debris on the cable, which can also change the diameter of the wheels. As such, the device must be recalibrated on-site (in the field) in order to account for wear and/or other damage to the measurement wheels. Also, heavily worn/damaged wheels must be replaced entirely.

Accordingly, a need exists for an improved system and method for measuring the movement of a conveyance system relative to an oil well during an oil well operation.

SUMMARY

In one embodiment, the present invention is a measurement system that includes an optics unit which measures at least one variable of the movement of a conveyance system relative to an oil well during an oil well operation, wherein the at least one variable is a direction of motion, a speed of movement, or a length of movement of the conveyance system.

In another embodiment, the present invention is a measurement system that includes an assembly which measures and records at least one of a direction of motion, a speed of movement and a length of a conveyance system entered into a well during a logging operation without physically contacting the conveyance system.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION OF EMBODIMENTS OF THE INVENTION

Figure 1:
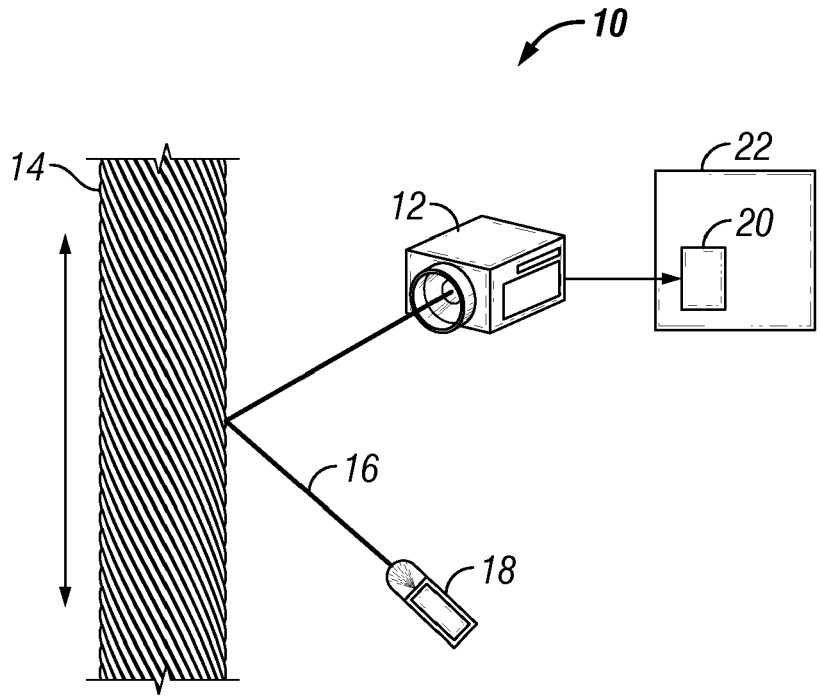
FIG. 1 is a schematic representation of a system for measuring at least one variable of the movement of a conveyance system relative to an oil well during an oil well operation.
Figure 2:
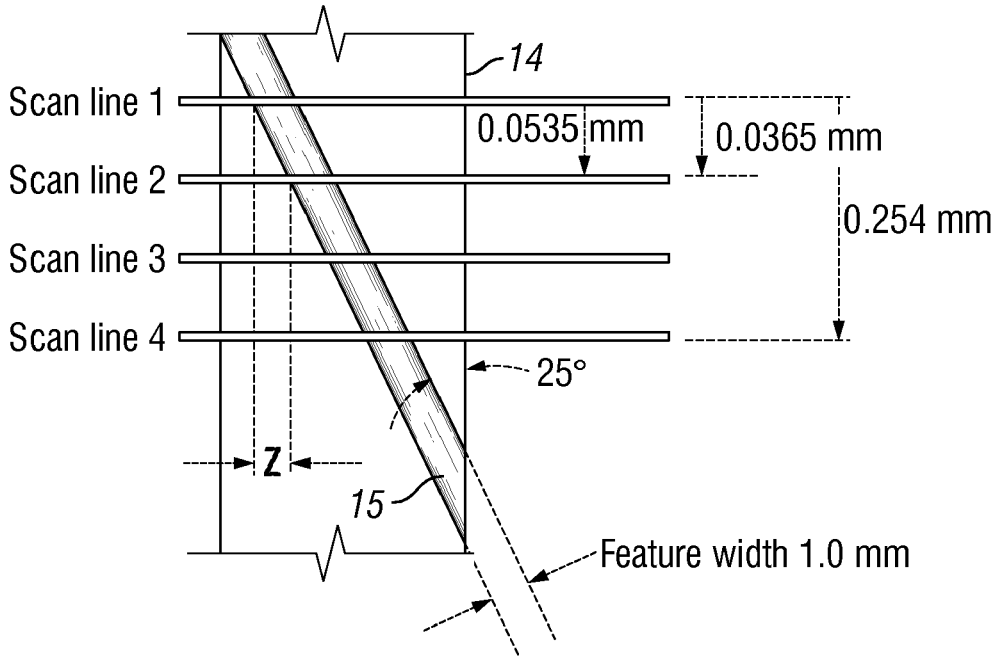
FIG. 2 is a schematic representation of the movement of a conveyance system, such as a cable, versus scanning by a camera according to one embodiment of the system of FIG. 1.
Figure 3:
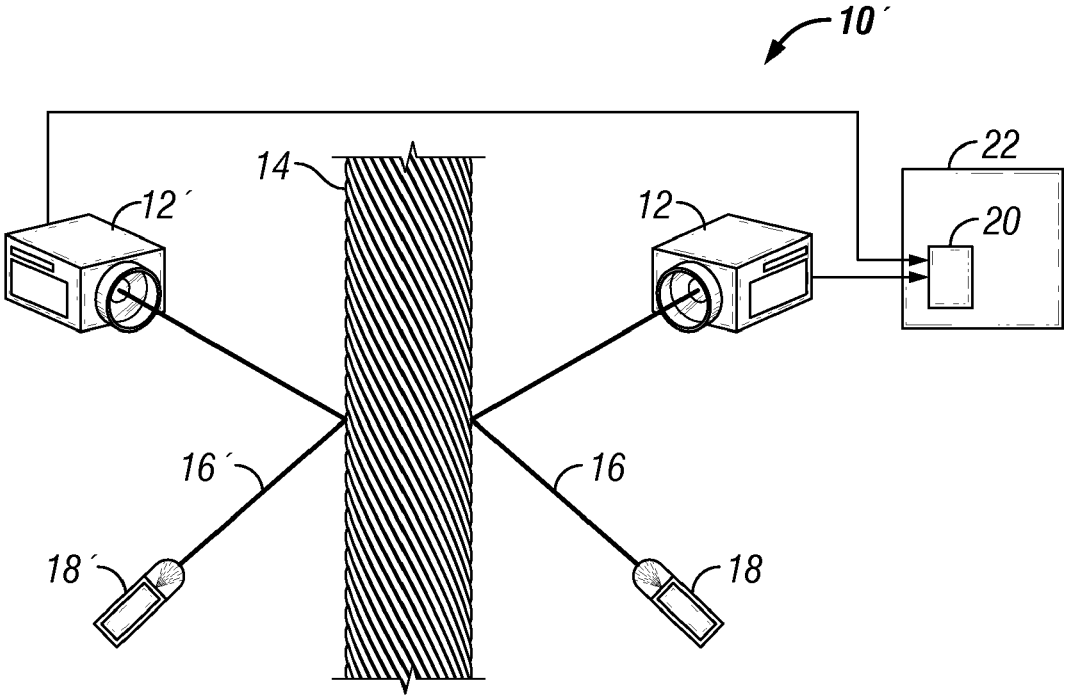
FIG. 3 is a schematic representation of a system for measuring at least one variable of the movement of a conveyance system relative to an oil well during an oil well operation according to an alternative embodiment of the invention.

As shown in FIGS. 1-3, embodiments of the present invention are directed to a measurement system and method for measuring at least one variable of the movement of a conveyance system relative to an oil well during an oil well operation. For example, in one embodiment the conveyance system is a cable that is run into an oil well in a logging operation. In such an operation, the measured variable may include the length of the cable that is run into the oil well. However, in other embodiments, the conveyance system may include other appropriate systems such as a coiled tubing string, and the variable of movement of the conveyance system may include other appropriate variables such as direction of motion, and speed of movement, among others. In addition, in embodiments where the conveyance system is a cable, the cable may be a slick-line cable or a wireline cable, among other appropriate cables.

In one embodiment, the inventive measurement system measures at least one variable of the movement of a conveyance system relative to an oil well during an oil well operation without physically contacting the conveyance system. For example, in one embodiment this non-contact measurement is accomplished by use of an optical system. By use of such an optical system, a very high tracking resolution is possible. Consequently, a variable of the movement of the conveyance system, such as an overall depth measurement of the conveyance system into a well, can be determined to a very high level of accuracy.

An optical measurement system according the present invention eliminates some of the problems of the prior art, such as slippage between the prior art measurement wheels and the conveyance system to be measured, as well as errors related to the wear of the prior art wheels. In addition, field calibrations of the system of the present invention are not necessary.

FIG. 1 shows a system 10 according to one embodiment of the present invention. The system 10 includes a camera 12 that includes optical sensors employing light and its detection in a non contact measurement technique. In one embodiment, the camera 12 is a CCD (Charge Coupled Device) camera. A CCD camera is a device for capturing an image electronically. The CCD camera 12 may be an area scan camera or a line scan camera, among other appropriate cameras. A line scan camera allows only a single line of an image to be captured at a time, whereas an area scan camera allows for the capture of a much larger area of an image. A trade off is that the speed at which individual images, or scans, are loaded into a computer memory and updated in a line scan CCD camera is much faster than that of an area scan CCD camera, which is advantageous in capturing images and features of fast moving material flow, such as the movement of a cable or a coiled tubing string into a well.

In one embodiment, such as that shown in FIG. 1, the CCD camera 12 is a line scan camera, which is used to extract one or more "features" (defined below) of a conveyance system 14. In the embodiment of FIG. 1, the conveyance system 14 is a cable, such as a wireline cable. However, as alluded to above, in other embodiments of the present invention, the cable 14 in FIG. 1 may be replaced by any other appropriate oil well conveyance system, such as a string of coiled tubing or a slick-line cable.

In one method according to the present invention, as the cable 14 is moved past the camera 12, the camera 12 takes "snapshot" scans or a "line of image" of the cable 14. During these scans, the camera 12 operates at a certain clock rate. For example, for a camera 12 clock rate of 20 Mhz and a line scan CCD camera 12 size which is 4096 pixels wide, a new line of image will be generated at a rate of approximately 10 KHz.

The lines of image from the line scan CCD camera 12 are captured by a frame grabber 20, which in turn is connected to a microprocessor board or a PC computer system 22. The frame grabber 20 allows the lines of image to be temporarily stored and processed by software in the computer system 22. Via the processing of the one or more features in the lines of image, and the processing of the cable motion direction by the computer system 22, a speed of travel and an accumulated distance of travel (or length) of the cable 14 is determined.

For example, as the camera 12 captures lines scans of the cable 14, a light 16 from a light source 18 is reflected from the surface of the cable 14. By focusing on a "feature" of the cable 14, a movement of the cable 14 can be calculated by analyzing the movement of the intensity of the reflected light from the cable 14. These "features" may be any repeating characteristic of the cable 14. Preferable, the feature is one which reflects light at a different intensity than the remainder of the cable 14. An example of such a feature is the pattern created by the individual wire stands of the cable 14 as they wrap around the core of the cable 14. Each strand reflects light at a greater intensity near its center point, and reflects light at a lesser intensity near its edges, which create poor areas of light reflection in the "crevices" created between adjacent strands of wire.

As explained further with respect to FIG. 2 below, by analyzing the movement of the intensity of light reflected by the strands 15 on the cable 14, the direction of movement, the length of movement and the speed of movement of the strands 15 (and hence the cable 14 itself) can be determined by the computer system 22. In one embodiment the camera 12 includes a matched aperture and LS (line scan) resolution to reliably monitor a motion of the cable 14 up to a cable speed of 30,000 ft/hr (2540 mm/sec).

In other embodiments, the feature may be a pattern, a color scheme, an etching or any other distinguishable characteristic of the conveyance system, whether the conveyance system is a cable, a coiled tubing string or another appropriate device. As stated above, preferable the feature is chosen such that it reflects light at a different intensity than the remainder of the conveyance system such that a distinguishable optic signature is created by the feature as light it reflected from it.

In one embodiment of the present invention, the following variables are used to determine the speed, length and direction of travel of a cable 14 that has passed in front of the camera 12, using the system depicted in FIG. 1:

1.) Line Scan CCD pixel height. In one embodiment, the camera optics are set up such that the effective pixel height and width is 0.01 mm; and the line size is 4096 pixels (although it is to be noted that a camera with a line size of 2048 pixels may also be used).

2.) Line scan CCD camera clock rate. In one embodiment, the camera 12 clock rate is at least 10 KHz.

3.) Cable feature width. In one embodiment the feature is a single wire strand of the cable 14. In such a case, the feature width is the diameter of the wire strand. The diameter of typical cable wire strand is between 1.0 to 2.0 mm.

4.) Cable mean width. In one embodiment, the cable 14 is a 7-46 cable that is approximately 12 mm wide. In another embodiment, the cable 14 is a 1-22 cable that is approximately 5.6 mm wide.

In one embodiment, a software algorithm in the computer system 22 processes and analyses the captured lines of image from the camera 12 in real time. After the features of the cable 14 have been extracted, the digital image of the cable 14 is built up using many lines (many more than are actually required for measurement.) This allows the system 10 to be tolerant of cable 14 defects, dirt particles, etc. The algorithm may also be used to identify objects that do not belong to the cable 14, such as grease, grit, dirt, water droplets and/or damaged cable armor.

As shown in FIG. 1, in one embodiment the line scan camera 12 is used together with a light source 18. In one embodiment, the light source 18 is an LED, emitting an infrared light operating in the non-visible range. This provides added "optical immunity" used to identify objects that do not belong to the cable 14, such as water vapor. An ultraviolet light source, or a visible light source may also be used depending upon the prevailing conditions, among other appropriate light sources. In embodiments where the light source emits a light in the visible range, polarization filters may be used to eliminate adverse reflections and negative optical effects.

Below are some variables used in a system 10 according to one embodiment of the present invention:

Camera and Field of View

Camera pixel length physical size (P)=$10*10^{-3}$ mm

Camera number of pixels (N)=4096

Camera line length physical size (L)=N*P=40.96 mm

Horizontal field of view (F)=40 mm

Effective pixel width (E)=P*(F/L)=$9.766*10^{-3}$ mm

Effective pixel height (H)=P*(F/L)=$9.766*10^{-3}$ mm

Other Information

Line Scan rate minimum (R)=10 KHz

Feature size average (A)=1.0 mm

Cable maximum speed (V)=2540 mm/sec (30,000 ft/hr)

Horizontal Resolution

Number of pixels per feature=A/E=102

Vertical Resolution

Cable distance traveled per scan (T)=V/R=0.254 mm

Number of scans/feature=A/T=3.94

In one embodiment, as the cable 14 travels through a spooling device, the camera 12 scans the cable 14. As shown in FIG. 2, when the camera 12 operates at a scan rate of 10 kHz, and the cable 14 travels at a speed of 2540 mm/sec (30,000 ft/hr), the cable 14 moves 0.0535 mm between scans (note that in FIG. 2 only a single strand of the cable 14 is shown for emphasis.) In such an embodiment, the individual scans are 0.01 mm high. As shown in FIG. 2, Z indicates the lateral motion of a cable wire 15 strand with respect to the camera 12. On a standard cable 14, wire strands are wrapped around a core with an inclination of about 25° to the longitudinal axis of the cable 14. Thus, for each scan, at a maximum cable speed of 2540 mm/sec (30,000 ft/hr), Z is 0.017 mm.

At a maximum cable speed of 2540 mm/sec (30,000 ft/hr), and using a line scan CCD camera 12, as described above, the cable 14 moves 1.7 pixels between scan lines. Averaging this movement over successive scans, using a moving window statistical average, allows the movement precision to be enhanced greatly. A camera 12 that can operate at a clock rate faster than 20 Mhz allows for even more lines and therefore less movement across the pixels for a scan. The number of lines required to detect the movement of a feature is only one. Therefore, the extra lines can be averaged or processed in such a fashion as to increase the effective vertical resolution of the system 10.

The wireline cable 14 depth measurement in the above described system 10 is based upon the extraction of features from images of the cable 14 (for example, a single wire strand is used as the feature in one embodiment of the present invention.) Each feature includes a specific pattern, such as the specific pattern provided by that individual wire strand 15 of the cable 14. The cable 14 under illumination from the light source 18, such as an infrared/ultraviolet/or another light source, appears as bands of varying light intensity. These bands of intensity, as part of the construction of the cable 14, have a particular optic signature, which in turn can be tracked in the image.

The amount of movement of a feature from one scan to the next allows the speed of the cable 14 to be calculated. There are various parameters that are required to be calibrated at the time of system commissioning. These parameters allow the software in the computer system 22 to determine the speed of the cable 14 from scan pixel effective height and the speed of the camera scanning. However, unlike the prior art system which requires numerous on site or field calibrations, the calibration of these parameters is an off-site, or a "factory master calibration."

As with the cable speed calculation, a determination of an amount of movement of a feature in a given number of camera scans allows the software in the computer system 22 to calculate the length of cable 14 that has been ran into a well. When the direction of the cable 14 changes, the direction of a feature motion across the camera 14 array also changes. This change in motion allows a positive or a negative length to be added to an accumulated length of the cable 14. As such, at the start of a particular logging operation, a zero datum may be set to facilitate this accumulated length calculation.

As mentioned above, although the proceeding description refers to the system 10 being used to measure the speed, direction of motion and/or depth of a wireline cable 14 in a well, the system 10 may also be used to measure the speed, direction of motion and/or depth of a coiled tubing string in a well by the same methods as described above.

In the embodiment of FIG. 3, the system 10' includes a first camera 12 and a second camera 12' each having a light source 18,18' for emitting a light 16,16' on a conveyance system 14 (note as with FIG. 1 the conveyance system is depicted as a cable, but may be any of appropriate conveyance system). The second camera 12', the second light source 18', and the second light 16' may be as described in any of the above embodiments of the camera 12, the light source 18, and the light 16. The second camera 12' sends information to the frame grabber 20 and the computer system 22 in the same manner as described above with respect to the camera 12.

In one embodiment, the first and second cameras 12,12' are diametrically opposed and operate completed independently of each other. In such an embodiment, their measurements are compared and contrasted for accuracy. In addition, the second camera 12' may be used as a back-up in case of failure or malfunction of the first camera 12.

Although embodiments of the present description have been described above for use in measuring at least one variable of the movement of a conveyance system relative to an oil well during an oil well operation, the pattern recognition techniques described above may also be used to identify faults on the spooled cable (i.e. worn or broken strands, kinks, bright spots, etc.) perform quality control, raise flags and initiate maintenance as part of a normal oil well operation, such as a well logging operation.

In one embodiment, the optical system 10 or 10' as described above may be used to measure the helix angle (for example, the helix angle on the cable 14 shown in FIG. 2 is 25°) of the cable 14 with respect to the cable centerline. Tension on the cable 14 as the cable 14 is lowered into a well results in elongation and an armor helix angle change. The optical system 10 or 10' allows keeping track and recording of this angle as the cable 14 gets spooled into a well. As tension increases the armor helix angle changes. Further change comes as the cable 14 is spooled back out and tension increases due to drag and friction forces on the cable 14 itself and attached downhole tools. A comparison between the armor helix angle 'spooling in' and 'spooling out' of the well allows calculating and applying a cable stretch correction.

The measurement of the armor helix angle gives basic information about the torsion stress on the cable 14 and helps to determine re-torquing. [During logging jobs with high tension the helically wrapped armor wires induce torque. Consequently cables have the tendency to rotate and to straighten out the armor to reduce the torque. This in turn results in a cable with improper outer armor, with a largely reduced safe working load.] By monitoring the armor helix angle of a cable 14 during an oil well operation, such as a logging operation, when the cable 14 is identified as having a helix angle which is too small, it may be sent for timely maintenance.

For the helix angle measurement, it is advantageous for the camera 12 to be angled with respect to the cable 14, such that the lines of image that the camera 12 scans are angled with respect to the longitudinal axis of the cable 12. However, in other embodiments of the invention, the camera 12 and the lines of image that the camera 12 scans may have any orientation with respect to the longitudinal axis of the cable 12. Although, in the above described movement measurements of the cable 12, it may be advantageous for the camera 12 and the lines of image that the camera 12 scans to either be parallel to or perpendicular to the longitudinal axis of the cable 14.

The preceding description has been presented with reference to presently preferred embodiments of the invention. Persons skilled in the art and technology to which this invention pertains will appreciate that alterations and changes in the described structures and methods of operation can be practiced without meaningfully departing from the principle, and scope of this invention. Accordingly, the foregoing description should not be read as pertaining only to the precise structures described and shown in the accompanying drawings, but rather should be read as consistent with and as support for the following claims, which are to have their fullest and fairest scope.

The invention claimed is:

1. A measurement system comprising:

an optics unit which measures at least one variable of the movement of a conveyance system relative to an oil well during an oil well operation, wherein the at least one variable is one of a direction of motion, a speed of movement and a length of movement of the conveyance system wherein the optics unit further comprises a light source which is reflected off of the conveyance system, and further wherein the light source is a LED light source that emits light at non-visible infrared wavelengths.

2. The measurement system of claim 1, wherein the conveyance system is one of a wireline cable, a slick-line cable, and a coiled tubing string.

3. The measurement system of claim 1, wherein the optics unit comprises a camera.

4. The measurement system of claim 3, wherein the camera is a line scan CCD camera which scans of plurality of lines of image of the conveyance system.

5. The measurement system of claim 4, wherein the camera is operable to reliably monitor said at least one variable of the movement of the conveyance system up to a speed of movement of the conveyance system of 30,000 ft/hr (2540 mm/sec).

6. The measurement system of claim 3, wherein the optics unit further comprises a second camera that serves to compare and contrast a monitoring of the movement of the conveyance system by the first camera.

7. The measurement system of claim 1, further comprising a computer system which performs pattern recognition on the plurality of lines of image scanned by the camera to determine said at least one variable of the movement of a conveyance system.

8. The measurement system of claim 7, wherein the computer system determines real time conveyance system speed and direction of motion.

9. The measurement system of claim 7, wherein the pattern recognition allows the computer system to do at least one of: identify defects in the conveyance system, perform quality control, raise flags, and initiate maintenance during the oil well operation.

10. The measurement system of claim 1, wherein the conveyance system is a wireline cable, the at least one variable of the movement of the cable is the length of movement of the cable, and the oil well operation is a logging operation.

11. A measurement system comprising:

an optics unit which measures at least one variable of the movement of a conveyance system relative to an oil well during an oil well operation, wherein the at least one variable is one of a direction of motion, a speed of movement and a length of movement of the conveyance system; and a computer system which performs pattern recognition on the plurality of lines of image scanned by the camera to determine said at least one variable of the movement of a conveyance system, wherein the computer system performs the pattern recognition on the plurality of lines of image scanned by the camera by analyzing a movement of a light intensity reflected from the conveyance system between successive line scans, which in turn is used to determine said at least one variable of the movement of a conveyance system.

12. A measurement system comprising:

an optics unit which measures at least one variable of the movement of a conveyance system relative to an oil well during an oil well operation, wherein the at least one variable is one of a direction of motion, a speed of movement and a length of movement of the conveyance system, and wherein the optics unit comprises:

a light source which is reflected off of the conveyance system;

a camera which scans a plurality of lines of image of the conveyance system; and a computer system which performs a pattern recognition on the plurality of lines of image scanned by the camera to determine said at least one variable of the movement of a conveyance system, wherein the camera is a line scan CCD camera that is operable to reliably monitor said at least one variable of the movement of the conveyance system up to a speed of movement of the conveyance system of 30,000 ft/hr (2540 mm/sec).

13. The measurement system of claim 12, wherein the conveyance system is one of a wireline cable, a slick-line cable and a coiled tubing string.

14. The measurement system of claim 12, wherein the light source is a LED light source that emits light at non-visible infrared wavelengths.

15. The measurement system of claim 12, wherein the camera is a line scan CCD camera that is operable to reliably monitor said at least one variable of the movement of the conveyance system up to a speed of movement of the conveyance system of 30,000 ft/hr (2540 mm/sec).

16. The measurement system of claim 12, wherein the computer system determines real time conveyance system speed and direction of motion.

17. The measurement system of claim 12, wherein the pattern recognition allows the computer system to do at least one of: identify defects in the conveyance system, perform quality control, raise flags, and initiate maintenance during the oil well operation.

18. The measurement system of claim 12, wherein the optics unit further comprises a second camera that serves to compare and contrast a monitoring of the movement of the conveyance system by the first camera.

19. The measurement system of claim 12, wherein the computer system performs the pattern recognition on the plurality of lines of image scanned by the camera by analyzing a movement of a light intensity reflected from the conveyance system between successive line scans, which in turn is used to determine said at least one variable of the movement of a conveyance system.

20. The measurement system of claim 12, wherein the conveyance system is a wireline cable, the at least one variable of the movement of the cable is the length of movement of the cable, and the oil well operation is a logging operation.

* * * * *